US006684734B2

(12) United States Patent
Gatzen

(10) Patent No.: US 6,684,734 B2
(45) Date of Patent: Feb. 3, 2004

(54) PEDAL ASSEMBLY FOR MUSICAL INSTRUMENTS

(76) Inventor: Robert A. Gatzen, 506 Silas Dean Hwy., Wethersfield, CT (US) 06109

( * ) Notice: Subject to any disclaimer, the term of this patent is extended or adjusted under 35 U.S.C. 154(b) by 56 days.

(21) Appl. No.: 10/150,793

(22) Filed: May 20, 2002

(65) Prior Publication Data

US 2003/0213329 A1 Nov. 20, 2003

(51) Int. Cl.[7] ..... G05G 1/14; G10D 13/02
(52) U.S. Cl. ..... 74/560; 74/512; 84/422.1
(58) Field of Search ..... 74/512, 560; 84/422.1, 84/422.2, 422.3

(56) References Cited

U.S. PATENT DOCUMENTS

| | | | | | |
|---|---|---|---|---|---|
| 922,706 | A | * | 5/1909 | Ludwig | 84/422.2 |
| 2,800,828 | A | * | 7/1957 | Moelleer | 84/422.1 |
| 2,893,284 | A | * | 7/1959 | Washington, Jr. | 84/422.1 |
| 3,316,792 | A | * | 5/1967 | Ippolito | 84/422.1 |
| 3,563,129 | A | * | 2/1971 | Cantrell | 84/422.1 |
| 3,797,356 | A | * | 3/1974 | Duffy et al. | 84/422.1 |
| 4,186,644 | A | * | 2/1980 | Kurosaki | 84/422.1 |
| 4,188,853 | A | * | 2/1980 | Bills | 84/422.1 |
| 4,235,146 | A | * | 11/1980 | Purdy | 84/422.1 |
| 4,346,638 | A | * | 8/1982 | Hoshino | 84/422.1 |
| 4,664,012 | A | * | 5/1987 | Barca | 84/422.1 |
| 4,691,613 | A | * | 9/1987 | Jacobson | 84/422.1 |
| 5,574,237 | A | * | 11/1996 | Yanagisawa | 84/422.1 |
| 5,998,718 | A | * | 12/1999 | Liao | 84/422.1 |
| 6,011,208 | A | * | 1/2000 | Hoshino | 84/422.1 |
| 6,359,205 | B1 | * | 3/2002 | Lombardi | 84/422.1 |
| 6,392,130 | B1 | * | 5/2002 | Carlson | 84/422.1 |

FOREIGN PATENT DOCUMENTS

| | | | | |
|---|---|---|---|---|
| GB | 2234045 | * | 1/1991 | G10D/13/02 |

* cited by examiner

*Primary Examiner*—Thomas R. Hannon
*Assistant Examiner*—Vicky A. Johnson
(74) *Attorney, Agent, or Firm*—Shook, Hardy & Bacon L.L.P.

(57) ABSTRACT

A pedal assembly for a bass drum or high hat cymbals. A flat base plate has a resilient pedal board clamped to it with the pedal board inclined to receive a foot. A beater stick is connected with the toe end of the pedal board by a linkage that drives the beater stick against a bass drum when the pedal is depressed. The resiliency of the pedal board returns it to its normal position when foot pressure is withdrawn. A striker pad limits the depression of the pedal board to limit the force that the beater stick can apply to the drum.

20 Claims, 3 Drawing Sheets

PEDAL ASSEMBLY FOR MUSICAL INSTRUMENTS

FIELD OF THE INVENTION

This invention relates generally to musical instruments and more particularly to a pedal assembly of the type used for playing bass drums and high hat cymbals.

BACKGROUND OF THE INVENTION

Pedal boards have been used by drummers since the early 1900s to allow them to use their feet to strike bass drums with foot actuated beater sticks. Since that time, the basic construction of the pedal mechanism has changed little. A hinged foot board is operated by the drummer's foot and is connected by a crank or cam linkage to an axle that turns when the pedal is depressed. The beater stick is mounted to the axle and is driven rotatively against the drum when the pedal is depressed.

One of the main problems with this construction is that a tension spring is needed to return the pedal to its original position and pull the beater away from the drum when the pedal board is released. The spring is connected by an eccentric to the axle so that the spring is stretched when the eccentric is turned as the axle is rotated by depression of the pedal. The deformation of the spring causes it to return the components to their original positions when the foot pressure of the drummer is released.

The resistance applied by a spring is inconsistent and uneven as its extension changes. The more a tension spring is stretched, the more resistance it offers. In a drum pedal assembly, this can be a significant problem because the spring is extended to its maximum and offers maximum resistance when the beater stick reaches a critical area just before and as it strikes the drum head. Excessive resistance is thus provided at the time the drum head is struck. The manner in which the spring is mounted making use of an eccentric creates pendulum type motion in addition to stretching, and this compounds the problem by complicating the motion at the point where evenness and consistency is most desirable. The result is that drummers have trouble achieving consistent striking action of the drum.

Springs can also create noise that may be picked up by a nearby microphone which is often provided to pick up the bass drum sound. Creaking and other unwanted noise can occur throughout the cycle of spring stretching and tends to be most pronounced when least wanted, at maximum spring tension when the drum is being struck. Although felt strips and other noise suppressing materials have been applied to the spring, the improvement in noise suppression is usually more than offset by interference of the felt with smooth and repeatable rebound action of the spring.

Springs are also subject to wearing out due to fatigue caused by repeated cycling of the spring. The fatigue factor is aggravated by the additional pendulum motion caused by the eccentric mounting. Even before a spring wears to the point of breaking, its efficiency and repeatability can suffer significantly due to wear. Additionally, the spring attaches to a roller cam that can wear unduly and further aggravate the situation.

The hinges that are required to mount conventional drum pedal boards also create problems. Hinges are subject to becoming worn and tend to become loose or sloppy as they wear. Undue noise such as rattling and unpredictable movement can result from a loose hinge connection. Also, the drummer must adjust his or her operation of the pedal as the hinge and/or spring becomes worn. Consistent and repeatable striking sounds are difficult if not impossible to achieve under these conditions.

The need for springs and hinges creates the need for cams, bearings and axles for the springs and similar components separately for the hinge. This adds to the cost, complexity and likelihood of mechanical problems as well as to the weight. Further, the need for a large number of components detracts from the "feel" the drummer is able to sense and the freedom of movement of the device as a whole.

High hat cymbals have commonly been controlled through a similar pedal construction. Similar problems are encountered with high hat cymbals due to the shortcomings associated with the use of springs and hinges in the pedal assembly.

BRIEF SUMMARY OF THE INVENTION

The present invention is directed to an improved pedal assembly for use in the music field. It is the principal goal of the invention to provide a pedal assembly that is constructed in a unique manner that eliminates the need for springs and hinges along with other problematic components such as eccentrics and the like.

It is a special feature of the invention that the pedal board is constructed of a flexible and resilient material that allows it to be depressed without the need for a hinge to mount it, and to revert to its normal position as a result of its inherent resiliency rather than requiring a separate spring system. The springless and hingeless construction eliminates the inefficiencies, inconsistencies, noise, wear, undue weight and complexity that have plagued the musical pedal assemblies used heretofore for bass drums and high hat cymbals. Furthermore, the pedal construction of the present invention has a better feel and freer movement.

In accordance with a preferred embodiment of the invention, a composite pedal board is provided and is constructed of a resilient material that naturally reverts to an undeformed condition when the foot pressure is released. The pedal has a reduced thickness heel that is clamped to a base plate and normally extends at an incline so that it can conveniently receive the foot of a drummer. The clamping mechanism that is preferably used to mount the pedal allows adjustment for more or less exposure of the thin heel area in order to change the flexibility exhibited by the pedal.

It is another important feature of the invention that a striker pad can be installed beneath the toe area of the pedal to limit the movement of the pedal downwardly. This in turn limits the contact force allowed of the beater stick against the drum while still allowing the drummer to pedal as aggressively as desired. This controls the sound level without inhibiting vigorous drumming. Also, the sound level is consistent because it remains virtually the same regardless of the forcefulness of the pedal operation. Even overly aggressive drummers can achieve a soft sound when necessary by adjusting the striker such that only relatively soft sound is possible.

In a preferred embodiment of the invention for use with a bass drum, the toe area of the pedal is connected with a link that in turn pivotally connects with a cam arm secured at its opposite end to an axle. The beater stick is mounted to a hub which is co-axial with the pivot connection of the link to the cam arm. This mounting arrangement causes a forward throw of the beater stick as well as rotation to enhance the beating action. Adjustments may be provided for the connection of the pedal to the link, the connection of the link to the cam arm, the effective length and throw of the beater stick, and the rotative location of the stick on the beater hub. All of these adjustments provide a wide range of adjustability in order to accommodate individual discretion.

The pedal assembly of the present invention is also useful for high hat cymbals and "silent" drum practice. In a high hat application, the resilient pedal can be connected with the cymbal control rod to eliminate the need for springs and other complexities that are associated with conventional high hat pedals. In order to practice silent bass drumming, the pedal can be disconnected from the beater stick linkage and still provide the feel of actually striking a drum. It can also serve as an electronic triggering device for electronic drums, as well as a foot actuated striking mechanism for other percussion sounds such as a cowbell, woodblock and others.

An existing foot board can be converted using the principals of the present invention to a springless and hingeless design. To accomplish this, a section of flexible pedal board material can be attached to the existing foot board and to the heel plate where it connects with the foot board of the existing device.

Other and further objects of the invention, together with the features of novelty appurtenant thereto, will appear in the course of the following description.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views.

DETAILED DESCRIPTION OF THE INVENTION

Figure 2:
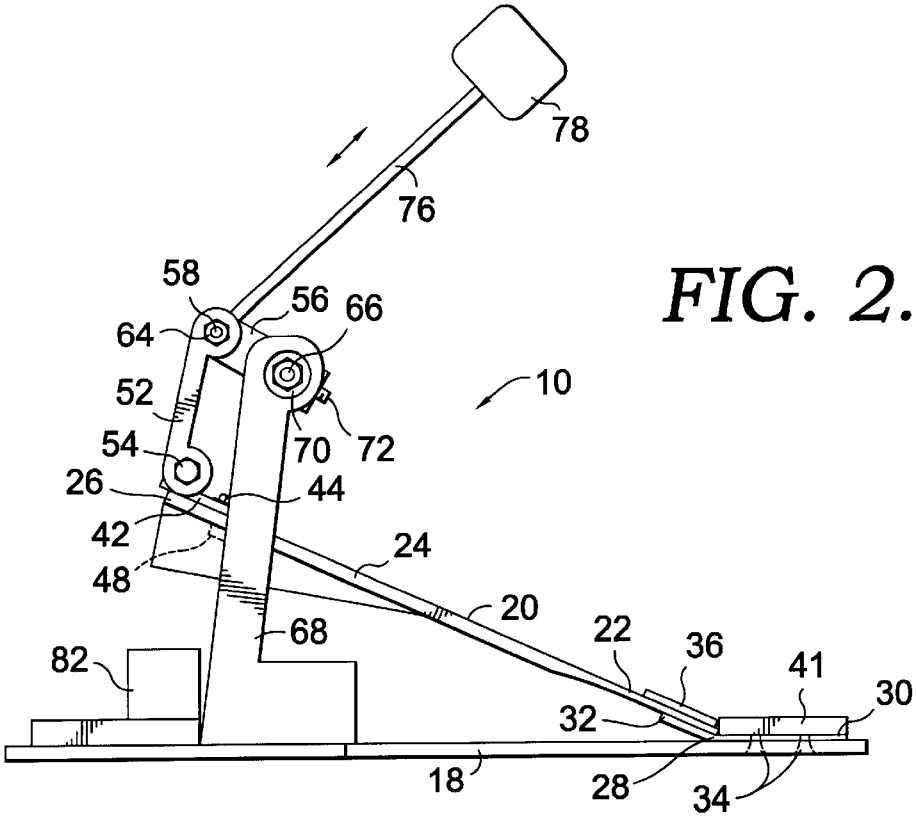
FIG. 2 is a side elevational view of the pedal assembly shown in FIG. 1.
Figure 4:
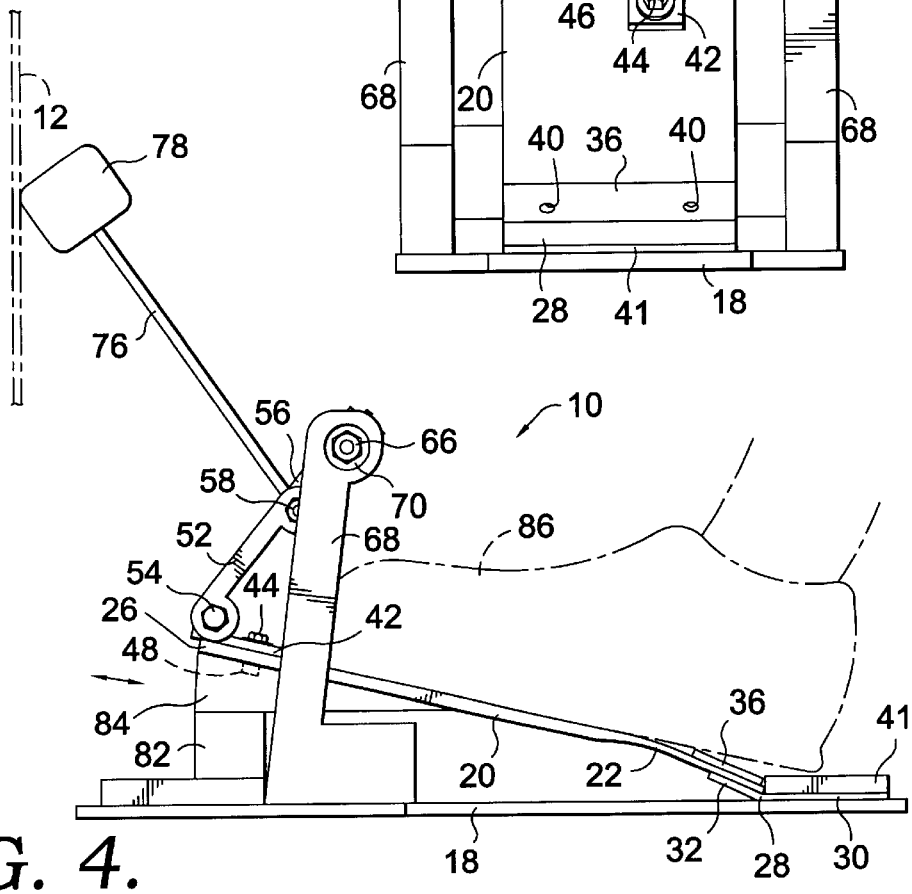
FIG. 4 is a side elevational view similar to FIG. 2, but showing the pedal board depressed by the foot of a user.

Referring now to the drawings in more detail, numeral 10 generally designates a musical pedal assembly which is operated by the foot of a user to play musical instruments such as a bass drum 12 (FIG. 4) or a high hat cymbal assembly 14 (see FIG. 5), as well as other percussion sounds including cowbells, woodblocks and others. The pedal assembly 10 includes a flat base plate 18 which rests on a floor, stage or other support surface. Mounted to the base plate 18 is a pedal board 20 which is constructed of a composite material that is inherently flexible and resilient. The pedal 20 may be rectangular and includes a heel portion 22 which is formed on one end of a body portion 24 of the pedal board. The heel portion 22 has a lesser thickness than the body portion 24, as best shown in FIGS. 2 and 4. Preferably, the heel portion 22 has a length that occupies approximately 20% of the full length of the pedal 20. The body 24 terminates in a toe portion 26 located on the end of the pedal 20 opposite the heel portion 22.

The pedal 20 is mounted to the base 18 by means of an angled plate 28 having a flat base portion 30 from which an inclined portion 32 angles upwardly and forwardly at an inclined angle that is selected for the incline of the pedal 20. The base portion 30 is secured on top of the heel area of the base plate 18 by suitable fasteners such as screws 34 (FIG. 2). The screws or other fasteners may be extended upwardly through the base plate 18 and threaded into the base portion 30 of plate 28.

Figure 1:
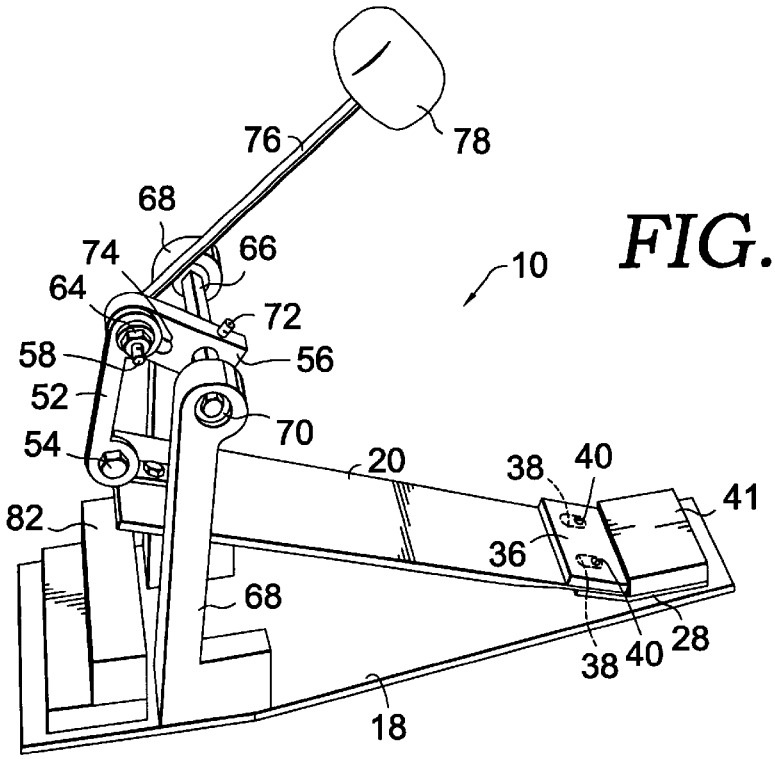
FIG. 1 is a perspective view of a bass drum pedal assembly constructed according to a preferred embodiment of the present invention.

The heel portion 22 of pedal 20 is secured between the inclined plate 32 and a clamp plate 36. The heel portion 22 is located on top of the inclined plate 32 and beneath the clamp plate 36 and is rigidly sandwiched between them. With reference to FIG. 1, the heel portion 22 is provided with a pair of spaced apart slots 38 located between the inclined plate 32 and the clamp plate 36. Fasteners such as screws 40 may be extended through openings in the clamp plate 36, through the slots 40 and into threaded openings in the underlying inclined plate 32. When the screws 40 are tightened, the heel portion 22 of the pedal is rigidly clamped between the plates 32 and 36. The provision of the slots 40 allows the heel portion 22 to be adjusted upwardly and downwardly in order to vary the length of the heel portion 22 that is exposed beyond the clamp plate 36. This in turn allows an adjustment of the flexibility of the pedal 20 in that the more of the thinner heel portion 22 that is exposed, the more flexibility the pedal exhibits.

A heel pad 41 is glued or otherwise secured on top of the base portion 30 of the angled plate 28. The heel pad 41 is located where it receives the heel of a drummer's foot applied to the pedal 20.

When used for playing of the bass drum, a small plate 42 is secured on top of the toe portion 26 of pedal 20. One or more fasteners such as a bolt 44 is extended through an opening in the plate 42 and through a slot 46 (FIG. 3) which is formed through the toe portion 26 of the pedal. A nut 48 (FIG. 4) may be threaded onto the end of the bolt 44 in order to secure the plate 42 in place on the pedal 20.

Figure 3:
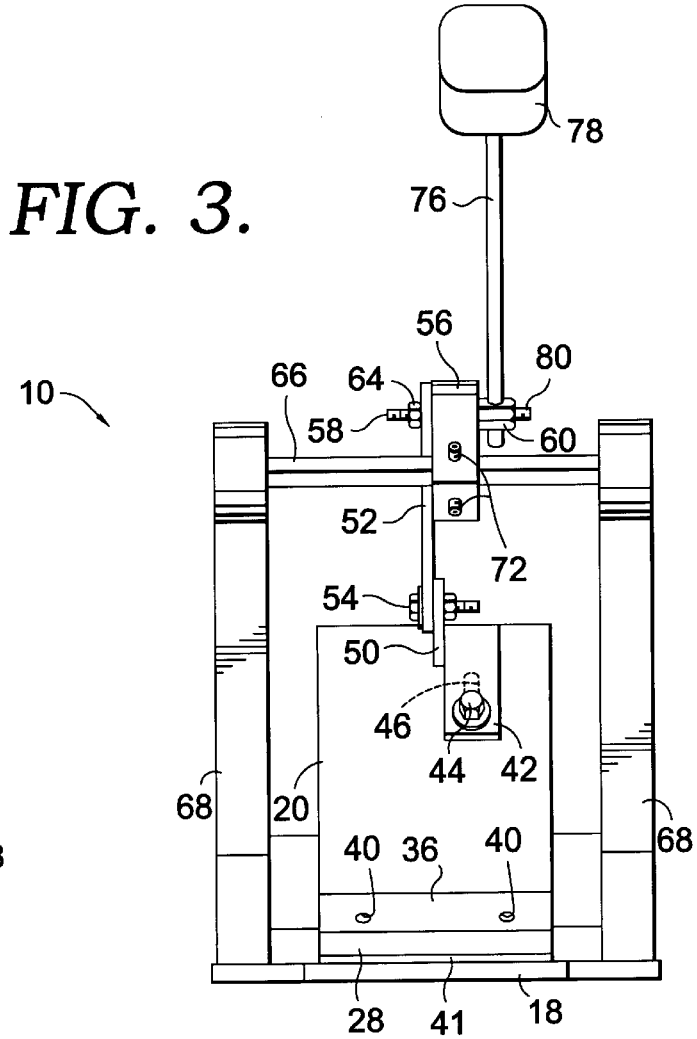
FIG. 3 is an end elevational view of the pedal assembly taken from the right side of FIG. 2.

As best shown in FIG. 3, a small tab 50 projects upwardly from one edge of the plate 42. The lower end of a rigid link 52 is pivotally connected with the tab 50 by a pivot coupling 54. The link 52 is able to pivot about the horizontal pivot axis provided by the coupling 54.

The upper end of the link 52 is connected pivotally with one end of a short cam arm 56. A threaded rod 58 is extended through openings in the link 52 and arm 56 and is threaded into one end of a beater hub 60 (FIG. 3). A nut 62 is threaded onto the rod 58 and tightened against the link 52 in a manner allowing the link 52 and arm 56 to pivot relative to one another about the horizontal pivot axis provided by the rod 58.

The end of the cam arm 56 opposite rod 58 is provided with an opening through which a horizontal axle 66 extends. The opposite ends of the axle 66 are supported on a frame provided by a pair of upstanding legs 68 suitably secured at their bottom ends to the base plate 18. The axle 66 is provided with bearings 70 that allow it to rotate on the legs 68 about a horizontal axis that is coincident with the axis of the axle 66.

A pair of set screws 72 are threaded into the cam arm 56 and may be tightened against flats provided on the axle 66 in order to secure the end of arm 56 rigidly to the axle 66. The set screws 72 may be loosened and the arm 56 turned in order to adjust its rotative position on the axle 66. The forward end of the arm 56 is provided with a slot 74 (FIG. 1) through which the threaded rod 58 extends so that the effective length of the arm 56 from shaft 66 can be adjusted.

A beater stick 76 is provided with a beater head 78 which is used for striking of the head of the base drum 12. The beater stick 76 is extended through an opening in the hub 60 and may be rigidly secured to the hub by tightening a set screw 80 (FIG. 3). When the set screw 80 is loosened, the stick 76 can be slid in and out relative to the hub 60 in order to change the effective length and throw of the stick 76.

A striker pad 82 is mounted on the toe portion of the base plate 18 at a location beneath the toe area 26 of pedal 20. The striker pad 82 is preferably constructed of rubber or a similar material. As best shown in FIG. 2, the underside of the toe portion 26 of pedal 20 is provided with a wedge block 84 that strikes the pad 82 when pedal 20 is fully depressed. The block 84 may be adjusted upwardly and downwardly in order to vary the extent of depression that is permitted of the pedal 20 before the block 84 contacts pad 82 to prevent additional depression of the pedal.

In use, the pedal assembly 10 is placed on a stage or floor at a position for striking the head of the bass drum 12. The drummer places his or her foot 86 (FIG. 4) on top of the pedal 20 and depresses the pedal with foot pressure in order to strike the drum head. As the pedal 20 is depressed from the normal position shown in FIG. 2 to the depressed position of FIG. 4, the bottom end of the link 52 is pulled downwardly with the toe 26 of the pedal, thus rotating the cam arm 56 in a counterclockwise direction from the position shown in FIG. 2 to the position shown in FIG. 4. This motion also rotates the hub 60 so that the stick 76 is rotated and thrust against the drum 12 to provide striking action of the beater head 78 against the drum.

When the foot pressure is released, the inherent resilient nature of the pedal 20 causes it to assume its normal position which is the position shown in FIG. 2. The beater stick is thus returned to its normal position shown in FIG. 2 along with all of the other components.

It is noted that when the pedal 20 is fully depressed, the block 84 contacts the striker pad 82 to provide a stop for limiting depression of the pedal. Consequently, regardless of how aggressively the pedal is depressed by the drummer, this arrangement limits the forcefulness of the striking of the beater head 78 against the drum. The block 84 can be adjusted upwardly and downwardly along the bottom surface of the toe area 26 of pedal 20 in order to adjust the extent of depression allowed for the pedal and thus adjusting the amount of force that can be applied against the drum 12.

Additional adjustments are provided such that the bottom end of the link 52 can be adjusted by means of the slot 46, the effective distance of the top end of link 52 from the axle 66 can be adjusted by means of the slot 74, the effective length of the beater stick 76 away from the pivot axis 58 can be adjusted by the sliding fit of the beater stick in the hub 60, and the rotational position of the cam arm 56 on the axle 66 can be adjusted. By properly setting all of these adjustments, the pedal assembly can be "fine tuned" for each individual drummer to provide the desired beater action against the drum 12. Further, the amount of flexibility exhibited by the pedal 20 can be adjusted by means of the slots 38.

Figure 5:
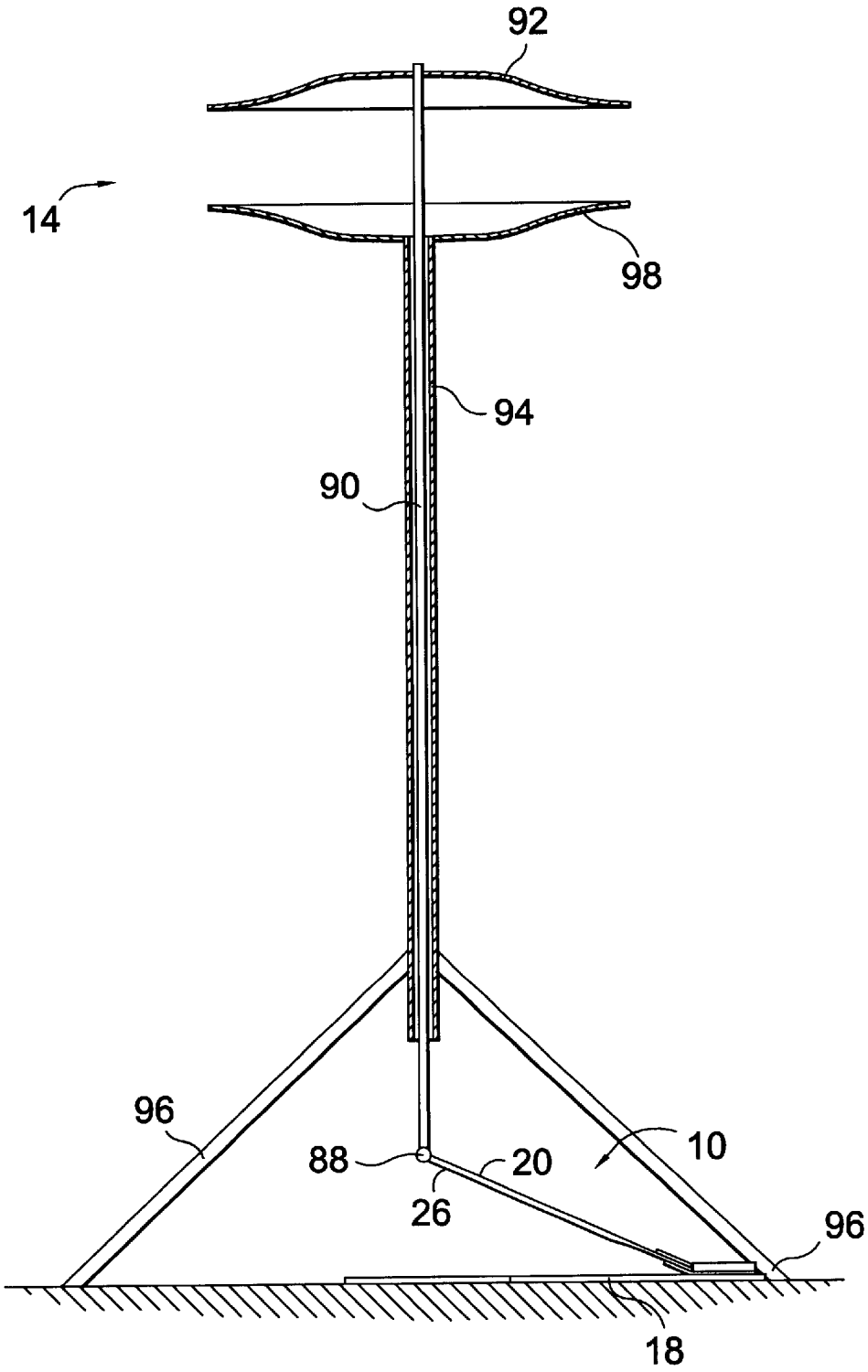
FIG. 5 is a diagrammatic elevational view showing a pedal assembly constructed in accordance with the present invention applied for use with high hat cymbals.

FIG. 5 diagrammatically shows the pedal assembly 10 used with high hat cymbals 14. The toe portion 26 of pedal 20 is pivotally connected at 88 with the lower end of a vertical rod 90 on which an upper cymbal 92 is mounted. The rod 90 fits slidably inside of a vertical sleeve 94 which may be mounted on a floor or other support surface by tripod legs 96. The top end of the sleeve 94 carries a lower cymbal 98 which is normally spaced below the upper cymbal 92. However, when the pedal 20 is depressed by the foot of the user, the rod 90 is pulled downwardly to strike the upper cymbal 92 against the lower cymbal 98. When the foot pressure is released, the inherent resiliency and flexibility of the pedal 20 causes it to revert to its normal position wherein the rod 90 moves upwardly and the upper cymbal 92 is spaced above the lower cymbal 92 in the position shown in FIG. 5.

The pedal construction of the present invention is also useful in a double bass drum arrangement having an auxiliary pedal that activates a secondary beater. This type of system eliminates the need for a second bass drum by providing twin beaters that strike a single drum head surface. This and other variations that use a resilient pedal are within the scope of this invention.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A pedal assembly for operating a musical instrument using a foot of a human user, said pedal assembly comprising:

a base for application to a support surface;

a flexible pedal having a resilient construction and a heel end connected with said base in a manner permitting said pedal to be flexed between a normal position wherein said pedal inclines upwardly away from said heel end and a depressed position wherein said pedal is displaced from said normal position, said resilient construction of the pedal urging said pedal toward said normal position when displaced therefrom; and a connection of said pedal to the musical instrument arranged in a manner to operate the instrument upon displacement of said pedal from said normal position to said depressed position by the foot of the user.

2. A pedal assembly as set forth in claim 1, wherein said pedal has a body portion connected with said heel end and having a thickness greater than a thickness of said heel end.

3. A pedal assembly as set forth in claim 2, wherein said connection comprises a clamp rigidly clamped to said heel end.

4. A pedal assembly as set forth in claim 3, including an adjustment of said clamp for allowing said body portion of the pedal to be adjusted toward and away from said clamp for varying the flexibility of said pedal.

5. A pedal assembly as set forth in claim 2, wherein said connection comprises:

a mounting plate connected with said base and having at least a portion of said mounting plate inclining upwardly away from said base; and a clamp plate clamping said heel end of the pedal between said portion of said mounting plate and said clamp plate.

6. A pedal assembly as set forth in claim 5, wherein said mounting plate comprises an angled plate having a generally flat base portion secured to said base with said portion of the mounting plate inclining upwardly from said base portion.

7. A pedal assembly as set forth in claim 6, including a heel pad on top of said base portion of said mounting plate.

8. A pedal assembly as set forth in claim 2, wherein said pedal has a length dimension and said heel end occupies approximately 20% of said length dimension.

9. A pedal assembly as set forth in claim 1, including a heel pad on said base adjacent to said heel end of the pedal.

10. A pedal assembly as set forth in claim 1, wherein said pedal has a toe end opposite said heel end thereof, and including a striker pad on said base at a location to be contacted by said toe portion in said depressed position of said pedal to limit depression of the pedal.

11. A pedal assembly for musical use, comprising:

a base for application to a support surface;

a flexible pedal having a resilient construction and a heel end connected with said base in a manner permitting said pedal to be flexed between a normal position wherein said pedal inclines upwardly away from said heel end and a depressed position wherein said pedal is displaced from said normal position, said resilient construction of the pedal urging said pedal toward said normal position when displaced therefrom; and a striker pad on said base at a location to be contacted by pedal in said depressed position thereof to limit the displacement of the pedal from said normal position.

12. A pedal assembly as set forth in claim 11, wherein said pedal assembly is useful as a practice device for playing a bass drum and including a toe portion fo said pedal and a striker on said toe portion for striking said striker pad.

13. A pedal assembly for a bass drum beater stick, said pedal assembly comprising:

a base for application to a support surface;

a flexible pedal having a resilient construction and a heel end connected with said base in a manner permitting said pedal to be flexed between a normal position wherein said pedal inclines upwardly away from said heel end and a depressed position wherein said pedal is displaced from said normal position, said resilient construction of the pedal urging said pedal toward said normal position when displaced therefrom; and a link connected pivotally with said pedal adjacent a toe end of the pedal opposite said heel end thereof;

a cam arm connected with said link at a substantially horizontal pivot axis, said beater stick being connected with said cam arm at said pivot axis; and a frame on said base on which said cam arm is mounted to turn on a cam axis offset from said pivot axis.

14. A pedal assembly as set forth in claim 13, including means for adjusting said link along a distance dimension of said pedal.

15. A pedal assembly as set forth in claim 14, including means for adjusting the location of said pivot axis along a length dimension of said cam arm.

16. A pedal assembly as set forth in claim 15, including means for adjusting the length of the beater stick measured from said pivot axis.

17. A pedal assembly as set forth in claim 16, including means, for adjusting the rotational angle at which the beater stick extends from said pivot axis.

18. A pedal assembly as set forth in claim 14, including means for adjusting the length of the beater stick measured from said pivot axis.

19. A pedal assembly as set forth in claim 13, including means for adjusting the location of said pivot axis along a length dimension of said cam arm.

20. A pedal assembly as set forth in claim 19, including means for adjusting the length of the beater stick measured from said pivot axis.

* * * * *